US006703985B2

(12) United States Patent
Lee

(10) Patent No.: US 6,703,985 B2
(45) Date of Patent: Mar. 9, 2004

(54) ANTENNA AND RADIO SIGNAL DETECTING DEVICE USING THE SAME

(75) Inventor: Sang-kun Lee, Seoul (KR)

(73) Assignee: Attowave Co. Ltd., Kyungki-do (KR)

( * ) Notice: Subject to any disclaimer, the term of this patent is extended or adjusted under 35 U.S.C. 154(b) by 0 days.

(21) Appl. No.: 09/980,085

(22) PCT Filed: Jul. 11, 2001

(86) PCT No.: PCT/KR01/01189

§ 371 (c)(1),
(2), (4) Date: Jul. 8, 2002

(87) PCT Pub. No.: WO02/063718

PCT Pub. Date: Aug. 15, 2002

(65) Prior Publication Data

US 2003/0011520 A1 Jan. 16, 2003

(51) Int. Cl.[7] ..... H01Q 13/00
(52) U.S. Cl. ..... 343/786; 343/700 MS
(58) Field of Search ..... 343/786, 772, 343/700 MS, 783

(56) References Cited

U.S. PATENT DOCUMENTS 5,889,497 A * 3/1999 Brooker et al. ..... 343/786
5,898,409 A * 4/1999 Holzman ..... 343/786
5,973,653 A * 10/1999 Kragalott et al. ..... 343/786

* cited by examiner

*Primary Examiner*—Hoang V. Nguyen
(74) *Attorney, Agent, or Firm*—Nixon & Vanderhye, P.C.; Frank P. Presta

(57) ABSTRACT

An antenna having wide-band characteristics and a radio signal detecting device using the antenna are provided. The antenna having wide-band characteristics includes: an insulating substrate; a first conductive layer formed on the top surface of the insulating substrate, the first conductive layer having a predetermined width from the front end of the insulating substrate to the rear end thereof; a second conductive layer formed on the bottom surface of the insulating substrate; and first and second conductive plates. The rear end of the first conductive plate is attached to the first conductive layer, the rear end of the second conductive plate is attached to the second conductive layer, and the front ends of the first and second conductive plates are parallel to and separated from each other. The wide-band antenna has a simple structure thereby reducing the overall size of a device. Furthermore, the antenna does not employ a dielectric at a received terminal thereof, thereby minimizing return loss at high frequencies and effecting wide-band operation.

16 Claims, 8 Drawing Sheets

| INPUT SIGNAL FREQUENCY | FIRST MIXER OUTPUT |
|---|---|
| 10.525 GHz | 1 GHz−L |
| 24.150 GHz | 1 GHz−H |
| 33.2−34.1 GHz | 1 GHz−L |
| 33.9−34.8 GHz | 300 MHz−L |
| 34.5−35.4 GHz | 300 MHz−H |
| 35.2−36.1 GHz | 1 GHz−H |

ANTENNA AND RADIO SIGNAL DETECTING DEVICE USING THE SAME

TECHNICAL FIELD

The present invention relates to an antenna and a radio signal detecting device using the same, and more particularly, to an antenna with a wide-band capability, which is fed to a microstrip, and a radio signal detecting device for detecting electromagnetic waves using the same.

BACKGROUND ART

Antennas printed on a dielectric substrate have been developed since the late 1970s and used for commercial applications such as global positioning systems (GPS) as well as for military purposes such as airplanes, missiles or rockets. In most applications, tapered slot antennas (TSA) are used. TSAs have many advantages including low profile, light weight, ease of fabrication and installation, high gain, and symmetrical beam patterns. In a TSA, which basically includes a feed, a matching portion, and a radiating portion, a metal surface can be formed in various shapes on a dielectric substrate.

FIGS. 1A and 1B are top and rear views of a TSA. Referring to FIGS. 1A and 1B, a dielectric substrate of the TSA has a metallization surface on both sides thereof. The antipodal TSA, shown in FIGS. 1A and 1B, is formed by gradually flaring strip conductors of a balanced microstrip on opposite sides of the dielectric substrate by an angle a with respect to the antenna axis, thus allowing the antenna to be excited by a microstrip feed.

TSAs have wide-band characteristics and can operate over frequency bands in the range of 10–35 GHz since they exhibit excellent impedance matching and do not include any component depending on a specific frequency. However, while TSAs may be effective in detection or radiation of polarized waves incident parallel to the planes of the TSAs, they suffer from attenuation in excess of about 10 dB of polarized waves incident perpendicularly to the planes. Thus, if vertically polarized waves are to be detected or radiated, the plane of an antenna needs to stand vertically, which is not suitable for apparatuses of small dimensions.

Due to the above problem, it is difficult to apply the TSA to a radio signal detecting device for detecting microwave signals radiated from a speed gun used for measurement of vehicle velocity. Horn antennas are generally used in current radio signal detecting devices.

FIG. 2 is a block diagram showing the configuration of a radio signal detecting device fabricated using a horn antenna. Referring to FIG. 2, if microwave signals radiated from a speed gun are received by a horn antenna 200, the received microwave signals are introduced into a waveguide, and a mixing diode 210 combines the microwave signals with an oscillating signal from a resonator 220 to shift the signals to an intermediate frequency in the waveguide. A demodulator 230 demodulates the signals shifted to the intermediate frequency, and if a controller 240 determines that the demodulated signals are microwave signals radiated from a speed gun, an output unit 250 informs a user of the presence of the speed gun.

However, the radio signal detecting device has problems in that the structure is complicated and it suffers from the loss of a large amount of incident waves since the waveguide having narrow-band-pass characteristics does not propagate a signal whose half-wavelength is smaller than its width.

DISCLOSURE OF THE INVENTION

To solve the above problems, it is a first object of the present invention to provide an antenna having wide band characteristics.

It is a second object of the present invention to provide a radio signal detecting device using the antenna having wide-band characteristics.

In order to achieve the first object, the present invention provides an antenna having wide-band characteristics, which includes: an insulating substrate; a first conductive layer formed on the top surface of the insulating substrate, the first conductive layer having a predetermined width from the front end of the insulating substrate to the rear end thereof; a second conductive layer formed on the bottom surface of the insulating substrate; and first and second conductive plates. The rear end of the first conductive plate is attached to the first conductive layer, the rear end of the second conductive plate is attached to the second conductive layer, and the front ends of the first and second conductive plates are parallel to and separated from each other.

In order to achieve the second object, the present invention provides a radio signal detecting device using the antenna having wide-band characteristics, which includes: an antenna comprising an insulating substrate, a first conductive layer formed on the top surface of the insulating substrate, a second conductive layer formed on the bottom surface thereof, and first and second conductive plates, wherein the rear end of the first conductive plate is attached to the front end of the insulating substrate formed on the top surface thereof, the rear end of the second conductive plate is attached to the bottom surface thereof, and the front ends of the first and second conductive plates are parallel to and separated from each other; a demodulating circuit that demodulates a signal received from the antenna; a central processing unit (CPU) that receives the demodulated signal and determines whether the received signal is a signal radiated from a speed gun, determines the frequency band and intensity of the received signal, and outputs a predetermined signal; and an indicating portion that outputs a visual or auditory signal according to a signal received from the CPU and an output mode selected by a user.

BEST MODE FOR CARRYING OUT THE INVENTION

Figure 1A:
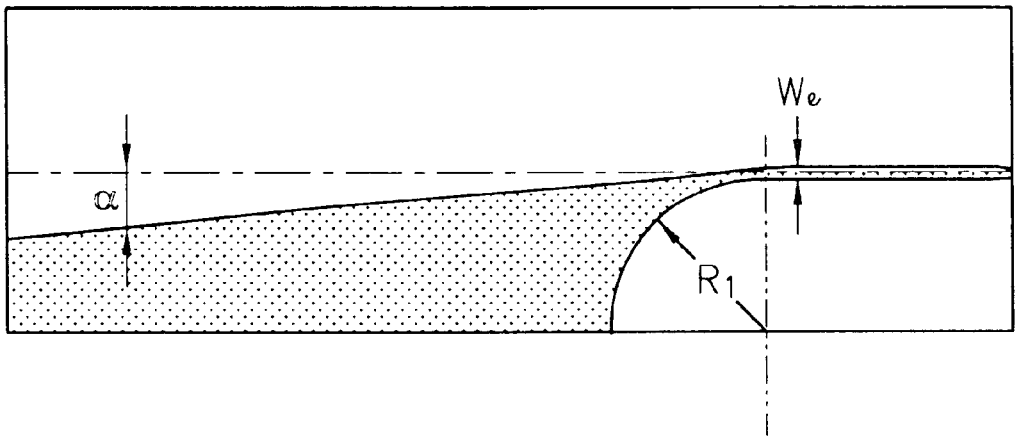
FIG. 1A is a top view of a conventional tapered slot antenna (TSA)
Figure 1B:
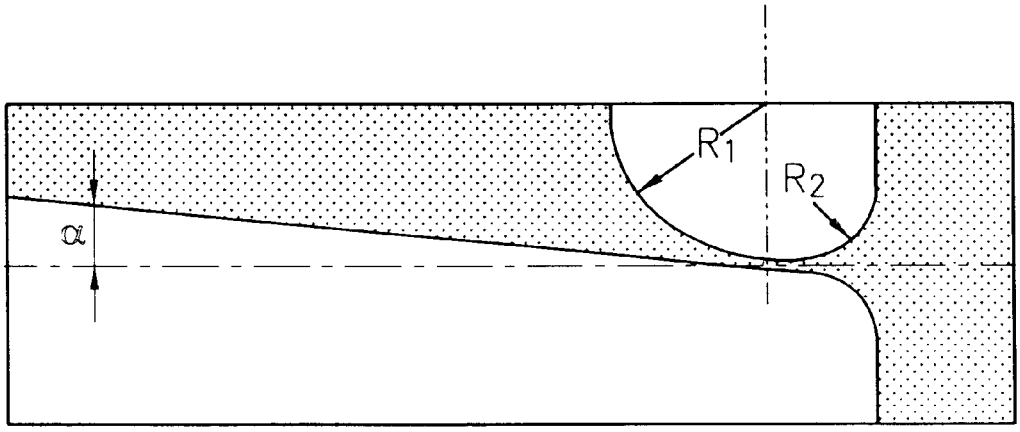
FIG. 1B is a rear view of a conventional TSA.
Figure 2:
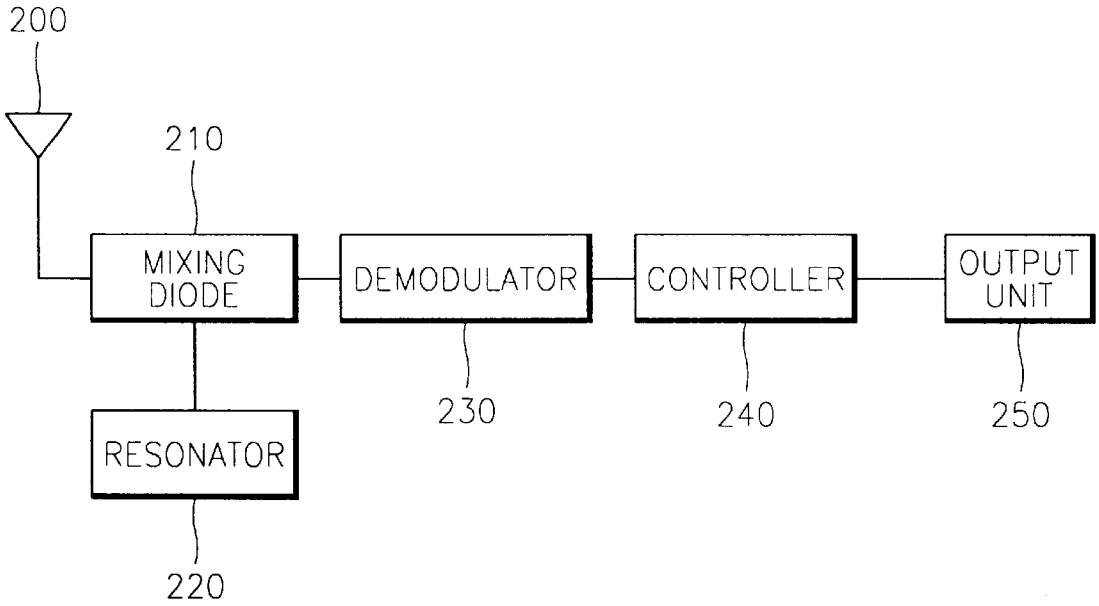
FIG. 2 is a block diagram showing the configuration of a conventional radio signal detecting device fabricated using a horn antenna.

Terms used in the specification are defined as follows with respect to FIGS. 3A and 3B. A top surface of an insulating substrate 300 refers to a surface on which a first conductive layer 310 is formed, while a bottom surface thereof refers to a surface on which a second conductive layer 340 is formed. The front end of the insulating substrate 300, which is rectangular shaped, refers to a side coupled to first and second conductive plates 320 and 330, while the rear end refers to a side coupled to a connecting element 350. The sides of the insulating substrate 300 refer to the two sides not including the front and rear ends thereof. The rear ends of the first and second conductive plates 320 and 330 having a substantially trapezoidal shape refer to sides coupled to the insulating substrate 300, while the front ends thereof refer to the sides located opposite the rear ends. The sides of the first and second conductive plates 320 and 330 refer to the two sides not including the front and rear ends thereof. The front end of the second conductive layer 340 refers to a side coupled to the second conductive plate 330 while the rear end thereof is a side coupled to the connecting element 350. The conductive layer 340 is partitioned into a feed and an impedance matching portion. The feed is formed in a rectangular shape at the rear end of the insulating substrate 300. The impedance matching portion has a substantially trapezoidal shape with a front side having the same width as that of the first conductive layer 310 and coupled to the second conductive plate 330, a rear side coupled to the feed, and two oblique sides formed to have a predetermined curvature.

Preferred embodiments of the present invention will now be described in detail with reference to the accompanying drawings. Referring to FIGS. 3A and 3B, the first conductive layer 310 formed on the top surface of the insulating substrate 300 has a predetermined width in a direction from the rear end to the front end of the insulating substrate 300. The width of the first conductive layer 310 is preferably about 1.4 mm. One end of the first conductive layer 310 is coupled to the first conductive plate 320, while the other end is coupled to the connecting element 350 for connecting a signal received by an antenna to a demodulating circuit. The second conductive layer 340 is formed on a bottom surface of the insulating substrate 300. More specifically, the second conductive layer 340 is formed on the external regions of two quadrants on the bottom surface of the insulating substrate 300. The center of a first quadrant is located at a vertex of the front end of the insulating substrate 300, while that of a second quadrant is located at the other vertex of the front end thereof. The first and second quadrants have a space corresponding to the width of the first conductive layer 310. The front side of the second conductive layer 340 coupled to the second conductive plate 340 has the same width as the first conductive layer 310, while the rear side is connected to the connecting element 350.

The first and second conductive plates 320 and 330 having a substantially trapezoidal shape are spatially separated from each other at a predetermined angle. The rear ends of the first and second conductive plates 320 and 330 have the same width as the first conductive layer 310, while the front ends, which are parallel to each other, are wider than the rear ends. The sides of the first and second conductive plates 320 and 330 have a rectilinear shape, but can be formed to have a predetermined curvature.

An air layer having a dielectric constant of 1 or a material having a dielectric constant similar to air may be filled between the first and second conductive plates 320 and 330. Since only the air layer having a dielectric constant of 1 is present between the first and second conductive plates 320 and 330, return loss is small at high frequencies. Vertically or horizontally polarized waves are radiated to or received from the atmosphere through the first and second conductive plates 320 and 330.

When radio waves are incident to the first and second conductive plates 320 and 330, the incident radio waves are fed through a microstrip formed by the first and second conductive layers 310 and 340 and transmitted to a demodulating element for demodulating the radio waves through the connecting element 350. A portion of the second conductive layer 340 connected to the second conductive plate 330 is preferably formed to have a predetermined curvature for impedance matching. The impedance matching is required to minimize reflections of the incident radio waves.

An antenna including triangular conductive plates 320-3 and 330-3 extending along one side of each of the first and second conductive plates 320 and 330 is used for detecting or radiating both vertically and horizontally polarized waves. That is, the antenna is configured such that the two triangular conductive plates 320-3 and 330-3 extend perpendicular to the ends 320-1 and 330-2 on one side of the first and second conductive plates 320 and 330, respectively. The antenna configured as above is shown in FIG. 3C.

Figure 3A:
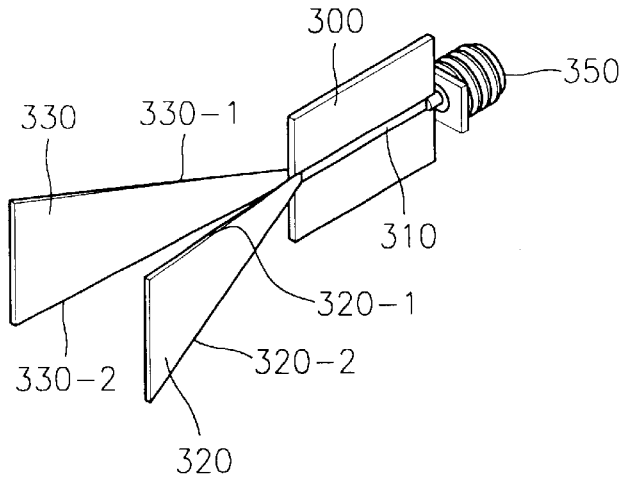
FIG. 3A is a perspective view showing the top surface of an antenna having wide-band characteristics according to an embodiment of the present invention.
Figure 3B:
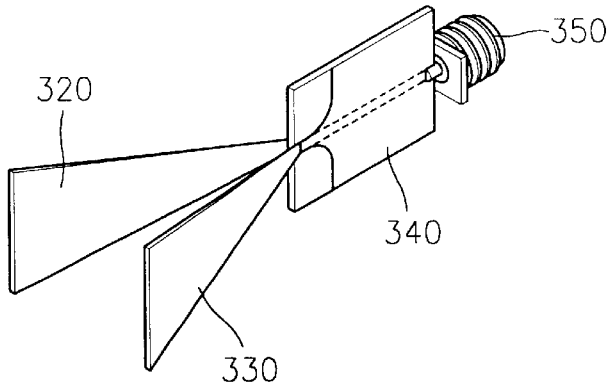
FIG. 3B is a perspective view showing the bottom surface of an antenna having wide-band characteristics according to an embodiment of the present invention
Figure 4A:
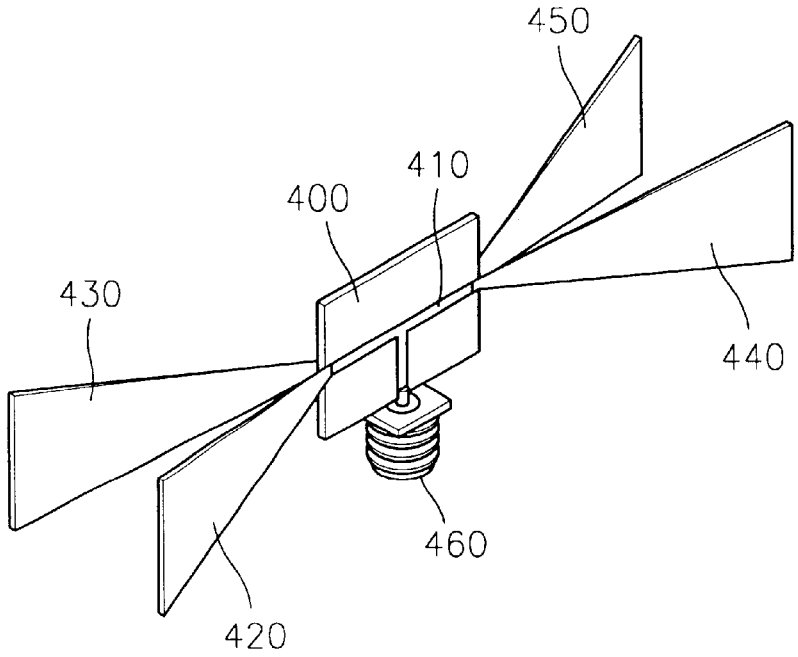
FIG. 4A is a perspective view showing the top surface of a wide-band antenna for receiving or transmitting electromagnetic waves in front of and behind the antenna according to another embodiment of the present invention.
Figure 4B:
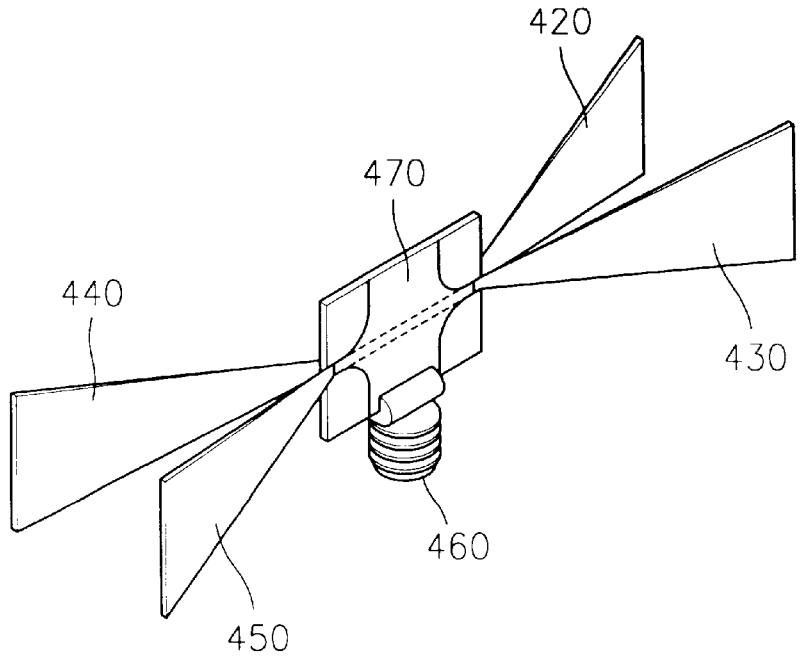
FIG. 4B is a perspective view showing the bottom surface of a wide-band antenna for receiving or transmitting electromagnetic waves in front of and behind the antenna according to another embodiment of the present invention.

FIGS. 4A and 4B are perspective views showing top and bottom surfaces of an antenna having wide-band characteristics according to another embodiment of the present invention. Referring to FIGS. 4A and 4B, a T-shaped first conductive layer 410 is formed on the top surface of an insulating substrate 400. The T-shaped first conductive layer 410 is divided into two parts: a first part having a predetermined width from the front end to the rear end and a second part having a predetermined width and extending from the middle of the first part to one side of the insulating substrate 300, the two parts being perpendicular to each other. The end of the second part thereof is coupled to the connecting element 460. The width of the first conductive layer 410 is preferably about 1.4 mm as described with references to FIGS. 3A and 3B. The ends of the first part of the first conductive layer 410 are coupled to first and third conductive plates 420 and 440.

A second conductive layer 470 is formed on the bottom surface of the insulating substrate 400. More specifically, the second conductive layer 470 is formed on the external regions of four quadrants on the bottom surface of the insulating substrate 400. The center of a first quadrant is located at a vertex of the front end of the insulating substrate 400 while that of a second quadrant is located at the other vertex of the front end thereof. The first and second quadrants have a space corresponding to the width of the first conductive layer 410. The center of a third quadrant is located at a vertex of the rear end of the insulating substrate 400 while that of a fourth quadrant is located at the other vertex of the rear end thereof. The third and fourth quadrants have a space corresponding to the width of the first conductive layer 410. The ends of the second conductive layer 470 are coupled to second and fourth conductive plates 430 and 450 and have the same width as the first conductive layer 410.

The first through fourth conductive plates 420, 430, 440, and 450 have a substantially trapezoidal shape. The first and second conductive plates 420 and 430 and the third and fourth conductive plates 440 and 450 are spatially separated from each other at a predetermined angle. The front ends of the first and second conductive plates 420 and 430, which are parallel to each other, are wider than the rear ends thereof. Also, the front ends of the third and fourth conductive plates 440 and 450, which are parallel to each other, are wider than the rear ends thereof. The rear ends of the first and third conductive plates 420 and 440 connected to the first conductive layer 410 have the same width as the first conductive layer 410. The rear ends of the second and fourth conductive plates 430 and 450 connected to the second conductive layer 470 also have the same width as the first conductive layer 410. The sides of the first through fourth conductive plates 420, 430, 440, and 450 have a rectilinear shape, but can be formed to have a predetermined curvature.

An air layer having a dielectric constant of 1 or a material having a dielectric constant similar to air may be filled between the first and second conductive plates 420 and 430 and between the third and fourth conductive plates 440 and 450. Vertically or horizontally polarized waves are radiated to or received from an atmosphere through the first through fourth conductive plates 420, 430, 440, and 450.

The principles of operation of the antenna described with references to FIGS. 4A and 4B are the same as those of the antenna described with reference to FIGS. 3A and 3B. While the former is advantageous in receiving incident radio waves in front of and behind the antenna, it has drawbacks in that when a radio signal received from one direction are transmitted to a demodulating element through the connecting element 460, some of the received signal leaks and is radiated into the air and return loss occurs as a result of reflection caused by failure in impedance matching. Furthermore, as described in FIG. 3C, the antenna may be configured such that triangular conductive plates extend along one side of each of the first and second conductive plates 420 and 430 and one side of each of the third and fourth conductive plates 440 and 450, the sides being positioned in a diagonal direction, to form quadrangular pyramids, thereby detecting both vertically and horizontally polarized waves.

Figure 5:
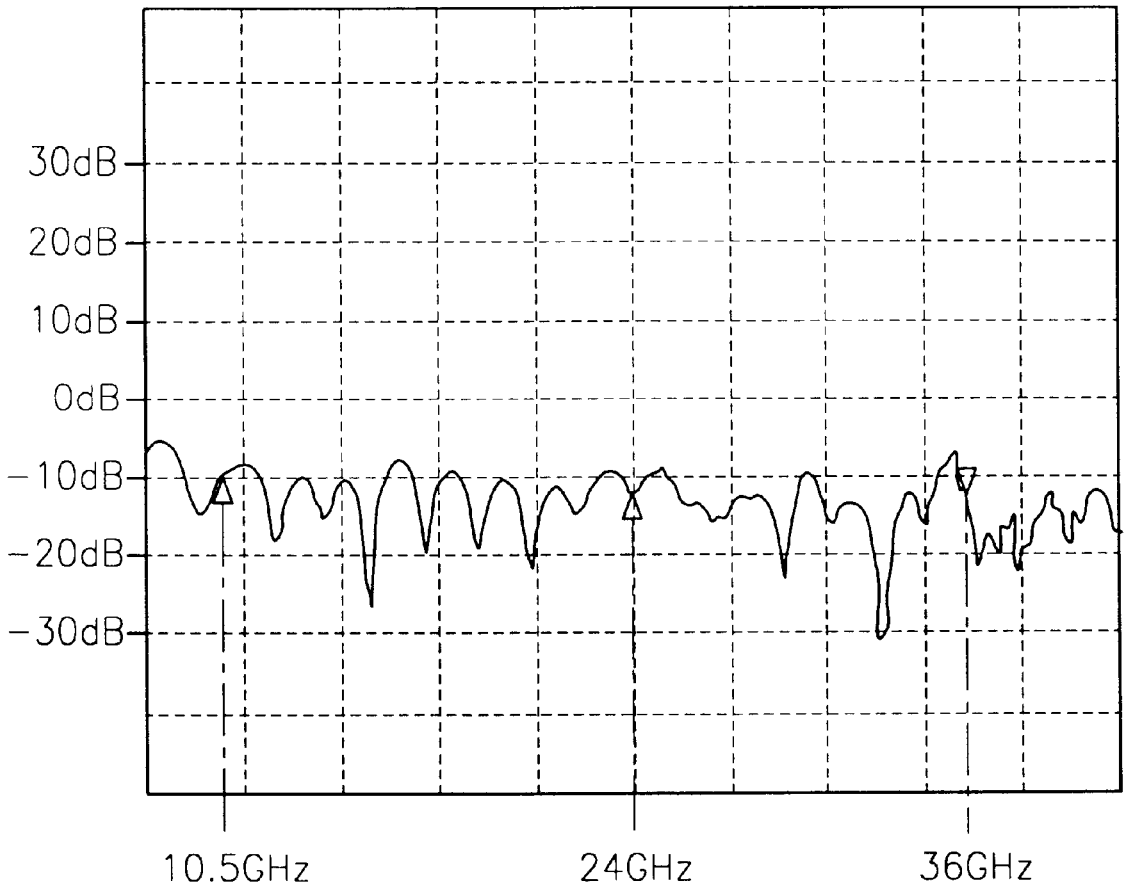
FIG. 5 shows the return loss of a wide-band antenna for receiving only E-plane radiation according to the present invention.

FIG. 5 shows a return loss waveform of an antenna receiving only E-plane radiation according to an embodiment of the present invention. Referring to FIG. 5, when frequencies of an input signal are 10.5, 24, and 35 GHz, return losses are 9.613, 11.856, and 12.454 dB, respectively. Thus, the antenna has wide-band characteristics and operates over a frequency band in the range of 10–35 GHz unless the antenna includes an element that only operates at a specific frequency.

The antennas described above have many applications, and in particular, they are suitable for a radio signal detecting device for detecting radio waves radiated from a speed gun for vehicle velocity measurement. For example, if the antenna described with reference to FIGS. 3A and 3B is used in a radio signal detecting device, the antenna includes the insulating substrate 300, which is a Teflon substrate with a length of 18 mm, a width of 18 mm, and a thickness of 0.5 mm, the first conductive layer 310 formed with a width of 1.4 mm on the insulating substrate 300, and the first and second conductive plates 320 and 330 having a substantially trapezoidal shape and a space 14 mm between the front ends thereof, each being formed with a length 18 mm of the front end, a length 1.4 mm of the rear end, and a length 32 mm between the front and rear ends. A radio signal detecting device equipped with the antenna obtains a directive gain of 4.5 dB with respect to radio waves of 10 GHz as a result of a CAD simulation.

Speed guns, which are currently in use, utilize radio signals having frequencies of 10.525, 24.15, and 33.6–36 GHz. Vehicle velocity measurements are made by radiating radio signals toward a moving a vehicle and using the reflected radio wave from the vehicle (Doppler effect). In order to recognize the presence of the speed gun before the speed of a vehicle is checked, it is necessary to detect radio signals radiated from the speed gun with an antenna of high sensitivity. The radio signal detecting device detects radio signals radiated from the speed gun thereby warning a driver of the velocity of the vehicle in advance.

Figure 6:
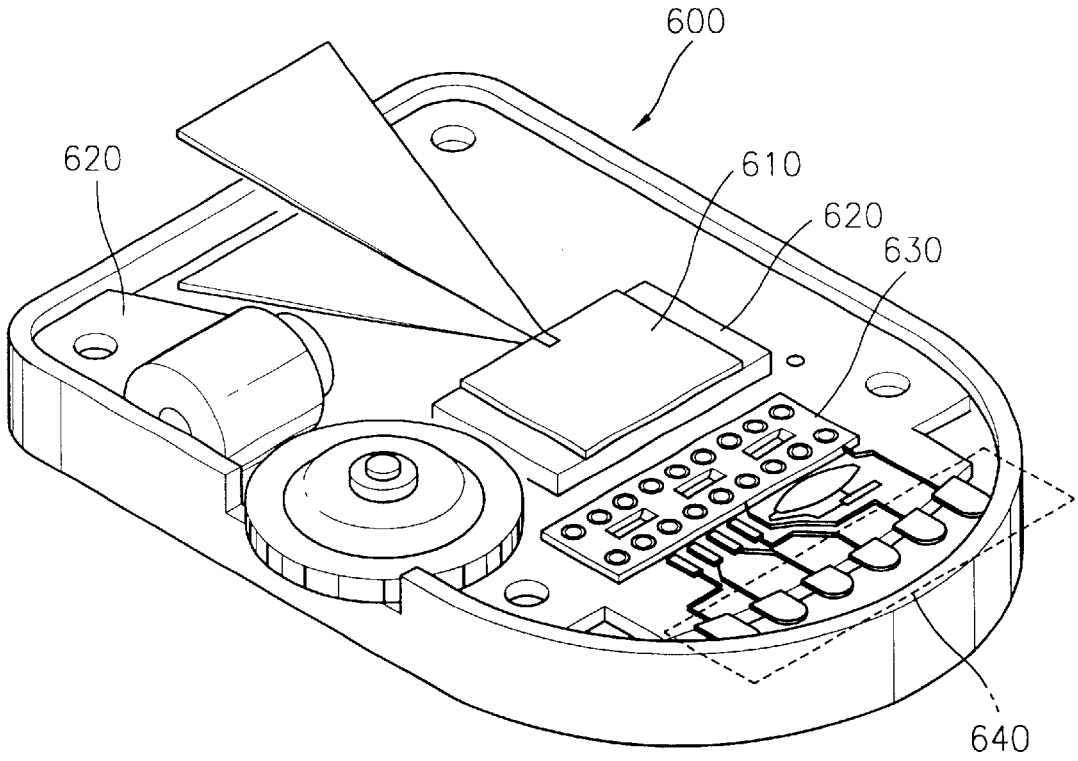
FIG. 6 shows the internal structure of a radio signal detecting device according to an embodiment of the present invention including a wide-band antenna according to the present invention.
Figures 7, 8:
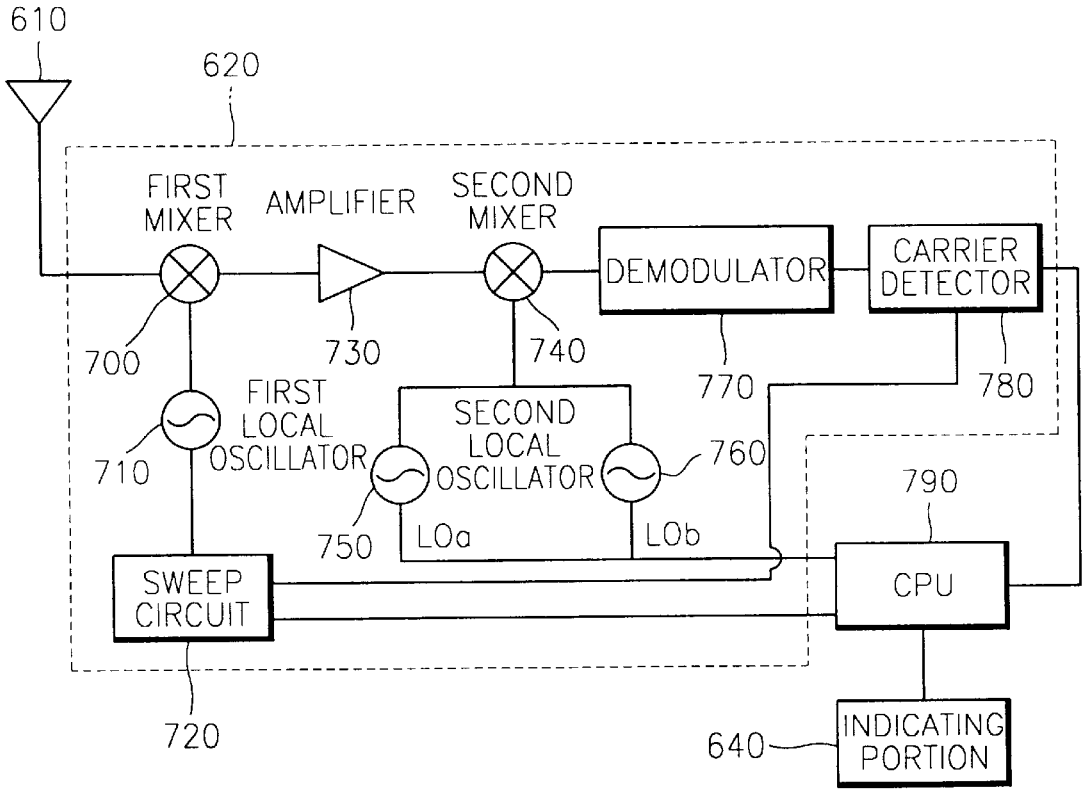
FIG. 7 is a block diagram showing the configuration of a radio signal detecting device including a wide-band antenna according to an embodiment of the present invention.
FIG. 8 shows the output of the first mixer with respect to changes in frequency of an input signal of the radio signal detecting device of FIG. 7.

FIG. 6 shows the internal structure of a radio signal detecting device including an antenna according to an embodiment of the present invention. FIG. 7 is a block diagram showing the configuration of the radio signal detecting device including an antenna according to an embodiment of the present invention. For ease of explanation, some components are omitted.

Referring to FIG. 6, a radio signal detecting device 600 includes an antenna element 610 for receiving a radio signal; a demodulating circuit 620 that shifts the frequency of the received signal, amplifies the received signal, shifts the amplified signal to an intermediate frequency, demodulates the signal, and filters out the demodulated signal; a central processing unit (CPU) 630 that determines whether the received signal is a signal radiated from a speed gun using the filtered signal, calculates the frequency band and intensity of the received signal, and outputs a predetermined signal; and an indicating portion 640 that outputs a visual or auditory signal based on the signal output by the CPU 630 according to an output mode selected by a user.

Providing the antenna 610 in front of and to the rear of a radio signal detecting device allows the presence of a speed gun to be confirmed irrespective of which way the vehicle is traveling.

Referring to FIG. 7, the demodulating circuit 620 includes a first mixer 700 that combines an input signal with an output signal of a first local oscillator 710 and outputs a first intermediate frequency, a first local oscillator 710 that outputs a signal to the first mixer 700 whose frequency varies over a predetermined range (for example, over the range of 11.4–11.7 GHz), a sweep circuit 720 that permits the first local oscillator 710 to sweep frequencies in the predetermined range according to control signals from a carrier detector 780 and a CPU 790, an amplifier 730 that amplifies the first intermediate frequency signal received from the first mixer 700, a second mixer 740 that combines the first intermediate frequency signal received from the amplifier 730 with an output signal of a second local oscillator 750 or 760 and outputs a second intermediate frequency signal, a demodulator that produces a demodulated pulse from the signal received from the second mixer 740, and the carrier detector 780, which detects a carrier wave from the signal received from the demodulator 770 and controls the operation of the sweep circuit 720 according to the frequency of the detected carrier wave.

A radio signal received from the antenna element 610 is input to the demodulating circuit 620. The first mixer 700 combines the received radio signal with an output signal of the first local oscillator 710 and outputs a first intermediate frequency signal. For example, if a radio signal having a frequency of 24.150 GHz is input to the first mixer 700, the received radio signal is combined with a second harmonic signal having a frequency range of 22.8 to 23.4 GHz, which is double the output signal of the first local oscillator 710 having a frequency range of 11.4 to 11.7 GHz. Through the above process, the received radio signal is shifted to the first intermediate frequency signal having a frequency range of 0.75 to 1.35 GHz. When the frequency of the first intermediate frequency signal is 989.3 MHz or 1010. 7 MHz, the first intermediate frequency signal is used in producing a second intermediate frequency signal. The signal having frequencies of 989.3 and 1010.7 MHz is produced when the output signal of the first local oscillator 710 sweeps frequencies between 11.4 and 11.7 GHz by way of the sweep circuit 720, and is input to the amplifier 730. The sweep circuit 720 for sweeping the output signal of the first local oscillator 710 in order to detect a wide-band radio signal is driven by the CPU 790, and its operation is held by the carrier detector 780.

FIG. 8 shows the output of the first mixer 700 depending on the frequencies of the received signal. In FIG. 8, 1 GHz-L refers to a signal having a frequency 10.7 MHz lower than 1 GHz, while 1 GHz-H refers to a signal having a frequency 10.7 MHz higher than 1 GHz. The same is true of 300 MHz-L and 300 MHz-H.

Returning to FIG. 7, the amplifier 730 amplifies the first intermediate frequency signal received from the first mixer 700 and outputs the result to the second mixer 740. The second mixer 740 combines the first intermediate frequency signal received from the amplifier 730 with a signal having a frequency of 300 MHz or 1 GHz received from the second local oscillator 750 or 760, and outputs a second intermediate frequency signal to the demodulator 770. For example, when a signal having a frequency of 1010.7 MHz is input to the second mixer 740, the second mixer 740 combines the received signal with the output signal of the second local oscillator 760 for outputting a signal having a frequency of 1 GHz to output a signal having a frequency of 10.7 MHz, which is a difference between both signals. The second local oscillators 750 and 760 output signals having frequencies of 300 MHz and 1 GHz, respectively. The second local oscillators 750 and 760 operate depending on the frequency band of an input signal. That is, the CPU 790 selects one of the second local oscillators 750 and 760 depending on the frequency band of the input signal.

The demodulator 770 produces a demodulated pulse from the second intermediate frequency signal received from the second mixer 740. For example, if a signal having a frequency of 24.150 GHz is received from the antenna element 610, the first mixer 700 combines the received signal with a signal received from the first local oscillator 710, thereby shifting the received signal to a first intermediate frequency signal having a frequency range of 0.75 to 1.35 GHz, and outputs the result to the amplifier 730. The amplifier 730 amplifies the first intermediate frequency signal and outputs the result to the second mixer 740. The second mixer 740 combines the amplified first intermediate frequency signal with an output signal of the second local oscillator 760 for outputting a signal having a frequency of 1 GHz to produce a second intermediate frequency signal. When the first intermediate frequencies are 989.3 and 1010.7 MHz, the second intermediate frequency is 10.7 MHz. Both first intermediate frequencies are produced when the first local oscillator 710 sweeps a frequency range of 11.4 to 11.7 GHz. The demodulator 770 generates one pulse each time it receives the second intermediate frequency signal of 10.7 MHz. Thus, two pulses are always generated in pairs, and necessary information such as the intensity of a signal is available from the interval between both pulses and the pulse lengths.

Figure 9:
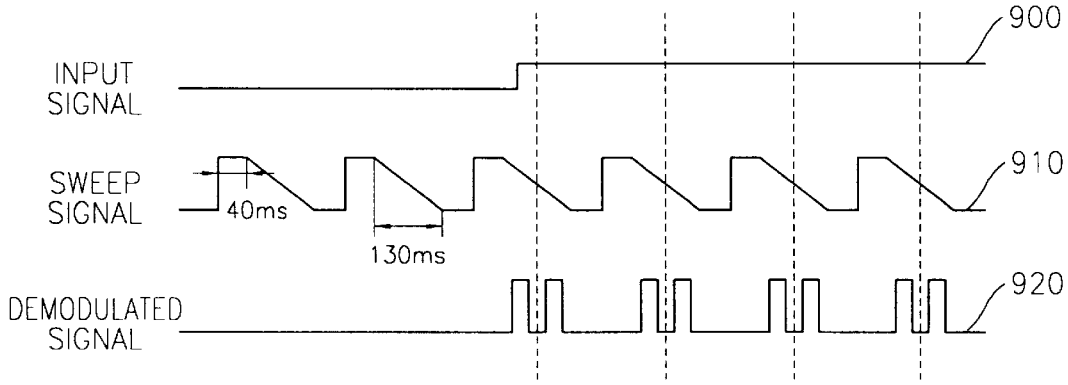
FIG. 9 shows the relationship among an input signal input to the first mixer from the antenna of the radio signal detecting device of FIG. 7 including the wide-band antenna according to the present invention, a sweep signal input from the first local oscillator to the first mixer, and a demodulated signal output from the demodulator.

FIG. 9 shows the relationship among a signal 900 received by the first mixer 700 through the antenna element 610, a sweep signal 910 input to the first local oscillator 710 from the sweep circuit 720, and a demodulated signal 920 output from the demodulator 770. Referring to FIG. 9, only the presence/absence of the received signal 900 is shown, and the sweep signal is a periodic sawtooth wave having a flat top. In order to obtain a pulse signal by demodulating a single carrier such as the received signal 900, the first local oscillator 710 sweeps a predetermined frequency band using the sweep circuit 720. To accomplish this, a falling edge of a sweep signal pulse has a predetermined slope.

When a signal is received from the antenna element 610, the received signal 900 is present. Then, the received signal 900 is shifted to the first and then the second intermediate frequency signals by the first and second mixers 700 and 740, respectively, and the second intermediate frequency signal is output to the demodulator 770. The demodulator 770 outputs two pulses according to the period of the sweep signal 910. The carrier detector 780 shapes the waveform of the demodulated signal received from the demodulator 770, and outputs the result to the CPU 790. Also, the carrier detector 780 controls the operation of the sweep circuit 720 depending on a carrier frequency band of the demodulated signal.

The CPU 790 determines whether the received signal 900 is a radio signal radiated from a speed gun, and determines the frequency band and intensity of the received signal 900 from the interval between the two pulses received from the carrier detector 780, and a pulse width. If the received signal 900 is a radio signal radiated from a speed gun, the indicating portion 640 is driven to warn the user of the presence of the speed gun. The indicating portion 640 includes one or more electroluminescent elements such as a light-emitting diode or a speaker. Preferably, the user can select whether a visual or auditory signal is output using an output mode selection button or the like.

Figure 3C:
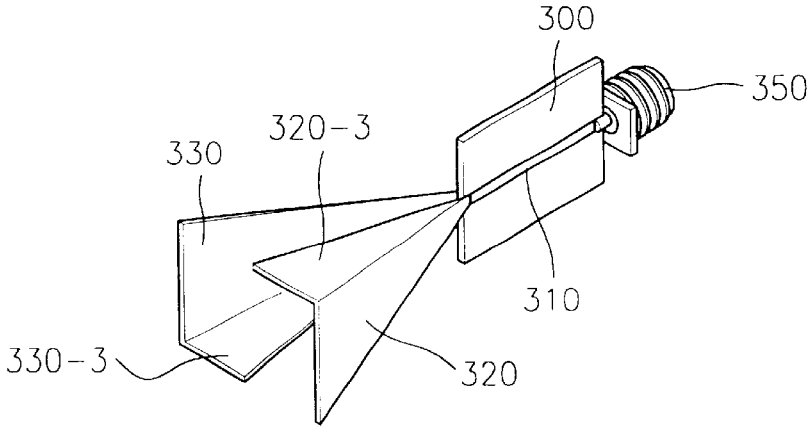
FIG. 3C is a perspective view of a wide-band antenna for receiving or transmitting both vertically and horizontally polarized waves according to an embodiment of the present invention.

Although the embodiment described above has been described with respect a radio signal detecting device including the antenna shown in FIGS. 3A and 3B, the antenna shown in FIGS. 4A and 4B may be used, thereby detecting the presence of the speed gun in front of and behind the radio signal detecting device. Furthermore, the above antennas modified as shown in FIG. 3C may be used, thereby providing a radio signal detecting device which permits detection of both vertically and horizontally polarized waves.

While this invention has been particularly shown and described with reference to a preferred embodiment thereof, it will be understood by those skilled in the art that various changes in form and details may be made therein without departing from the spirit and scope of the invention as defined by the appended claims.

Industrial Applicability

An antenna having wide-band characteristics according to the present invention has a simple structure, thus reducing the overall size of an applied device including the antenna. Furthermore, unlike a horn antenna, a simple structure of conductive plates of the antenna permits flexibility in selecting a wide range of alternative designs. The antenna does not use a dielectric at a receiving terminal thereof, thereby minimizing return loss at high frequency and providing wide-band operation. Furthermore, the conductive plates of the antenna are provided in front of and behind the antenna, thereby allowing for reception of radio waves in front of and behind the antenna. Also, the conductive plates of the antenna extend vertically, thus transmitting and receiving both vertically and horizontally polarized waves.

A radio signal detecting device including the antenna having wide-band characteristics according to the present invention can receive radio signals having various frequency bands, detect both vertically and horizontally polarized waves, and confirm the presence of a speed gun in front of or to the rear of the device. Furthermore, the radio signal detecting device according to the present invention is advantageous over a radio signal detecting device using a horn antenna in simplifying a structure by not requiring a mixing diode and a resonator.

What is claimed is:

1. An antenna comprising:

an insulating substrate;

a first conductive layer formed on the top surface of the insulating substrate, the first conductive layer having a predetermined width from the front end of the insulating substrate to the rear end thereof;

a second conductive layer formed on the bottom surface of the insulating substrate; and first and second conductive plates, wherein the rear end of the first conductive plate is attached to the first conductive layer, the rear end of the second conductive plate is attached to the second conductive layer, and the front ends of the first and second conductive plates are parallel to and separated from each other, wherein the second conductive layer is partitioned into a feed and an impedance matching portion, wherein the feed is formed in a rectangular shape at the rear end of the insulating substrate, and wherein the impedance matching portion has a substantially trapezoidal shape with a front side having the same width as that of the first conductive layer and coupled to the second conductive plate, a rear side coupled to the feed, and two oblique sides formed to have a predetermined curvature.

2. The antenna of claim 1, wherein the first and second conductive plates are formed in a substantially trapezoidal shape so that the width of the rear ends thereof is the same as the width of the first conductive layer and the front ends are wider than the rear ends.

3. The antenna of claim 2, wherein the sides of the first and second conductive plates have a predetermined curvature.

4. An antenna comprising:

an insulating substrate;

a first conductive layer formed on the top surface of the insulating substrate, the first conductive layer having a predetermined width from the front end of the insulating substrate to the rear end thereof;

a second conductive layer formed on the bottom surface of the insulating substrate; and first through fourth conductive plates;

wherein the rear ends of the first and second conductive plates are attached to the first and second conductive layers at the front end of the insulating substrate, respectively, wherein the rear ends of the third and fourth conductive plates are attached to the first and second conductive layers at the rear end of the insulating substrate, respectively, wherein the front ends of the first and second conductive plates are parallel to and separated from each other, and the front ends of the third and fourth conductive plates are parallel to and separated from each other, and wherein the first conductive layer has a T-shape including a first part having a predetermined width from the front end of the insulating substrate to the rear end thereof, and a second part extending down from a middle portion of the first part to one side of the insulating substrate, the two parts being perpendicular to each other.

5. The antenna of claim 4, wherein the second conductive layer is partitioned into first and second impedance matching portions and a feed, wherein the first impedance matching portion has a substantially trapezoidal shape with a front side, which has the same width as the first conductive layer and coupled to the second conductive plate, a rear side coupled to the feed, and two oblique sides having a predetermined curvature, wherein the second impedance matching portion has a substantially trapezoidal shape with a front side, which has the same width as the first conductive layer and coupled to the fourth conductive plate, and a rear side coupled to the feed, and two oblique sides having a predetermined curvature, and wherein the feed is formed in a rectangular shape between the first and second impedance matching portions.

6. The antenna of claim 4, wherein the first through fourth conductive plates are formed in a substantially trapezoidal shape so that the width of the rear ends thereof is the same as the width of the first conductive layer and the front ends thereof are wider than the rear ends.

7. The antenna of claim 6, wherein the sides of the first through fourth conductive plates have predetermined curvatures.

8. The antenna of claim 4, wherein the first through fourth conductive plates are formed in a substantially trapezoidal shape so that the rear ends thereof have the same width as the first conductive layer and the front ends thereof are wider than the rear ends, and the ends on one side of the first through fourth conductive plates extend perpendicularly in a triangular shape so that the triangular portions are perpendicular to opposite conductive plates, thereby forming quadrangular pyramids by the first through fourth conductive plates.

9. A radio signal detecting device comprising:

an antenna comprising an insulating substrate, a first conductive layer formed on the top surface of the insulating substrate, a second conductive layer formed on the bottom surface thereof, and first and second conductive plates, wherein the rear end of the first conductive plate is attached to the front end of the insulating substrate formed on the top surface thereof, the rear end of the second conductive plate is attached to the bottom surface thereof, and the front ends of the first and second conductive plates are parallel to and separated from each other;

a demodulating circuit that demodulates a signal received from the antenna;

a central processing unit (CPU) that receives the demodulated signal and determines whether the received signal is a signal radiated from a speed gun, determines the frequency band and intensity of the received signal, and outputs a predetermined signal; and an indicating portion that outputs a visual or auditory signal according to a signal received from the CPU and an output mode selected by a user.

10. The radio signal detecting device of claim 9, wherein the first conductive layer has a predetermined width from the front end of the insulating substrate to the rear end thereof, and the second conductive layer is partitioned into a feed and an impedance matching portion, wherein the feed is formed in a rectangular shape at the rear end of the insulating substrate, and wherein the impedance matching portion has a substantially trapezoidal shape with a front side, which has the same width as the first conductive layer and coupled to the second conductive layer, a rear side coupled to the feed, and two oblique sides formed to have a predetermined curvature.

11. The radio signal detecting device of claim 9, further comprising third and fourth conductive plates, wherein the rear ends of the third and fourth conductive plates are attached to the first and second conductive layers at the rear ends of the insulating substrate, respectively, the front ends thereof are parallel to and separated form each other, the first conductive layer has a T-shape including a first part having a predetermined width from the front end of the insulating substrate to the rear end thereof, and a second part extending down from a middle portion of the first part to one side of the insulating substrate, the two parts being perpendicular to each other.

12. The radio signal detecting device of claim 9, wherein the first and second conductive plates are formed in a substantially trapezoidal shape so that the width of the rear ends thereof is the same as the width of the first conductive layer and the front ends are wider than the rear ends, and ends on one side of the first and second conductive plates extend in a triangular shape so that the triangular portion of one conductive plate is perpendicular to the opposite conductive plate, thereby forming a quadrangular pyramid by the first and second conductive plates.

13. The radio signal detecting device of claim 9, wherein the sides of the first and second conductive plates of the antenna have a predetermined curvature.

14. The radio signal detecting device of claim 9, wherein the demodulating circuit comprises:

a first local oscillator that outputs varying frequencies;

a sweep circuit that sweeps the first local oscillator;

a first mixer that combines the signal received from the antenna with the output signal of the first local oscillator and outputs a signal having a frequency corresponding to the difference between the frequencies of both signals an amplifier that amplifies the signal received from the first mixer;

a plurality of second local oscillators, each outputting a signal having a different frequency;

a second mixer that combines the signal received from the amplifier with the signal received from each of the plurality of second local oscillators and outputs a signal having a frequency corresponding to a difference in the frequencies of both signals;

a demodulator that demodulates a signal received from the second mixer and outputs a pulse; and a carrier detector that detects a carrier from the signal received from the demodulator while shaping the waveform of the demodulated signal.

15. The radio signal detecting device of claim 14 wherein the signal output from the sweep circuit is a sawtooth wave having a predetermined slope and a flat top.

16. An antenna comprising:

an insulating substrate;

a first conductive layer formed on the top surface of the insulating substrate, the first conductive layer having a predetermined width from the front end of the insulating substrate to the rear end thereof;

a second conductive layer formed on the bottom surface of the insulating substrate; and first and second conductive plates, wherein the rear end of the first conductive plate is attached to the first conductive layer, the rear end of the second conductive plate is attached to the second conductive layer, and the front ends of the first and second conductive plates are parallel to and separated from each other, wherein the first and second conductive plates are formed in a substantially trapezoidal shape so that the width of the rear ends thereof is the same as the width of the first conductive layer and the front ends are wider than the rear ends, and the ends on one side of the first and second conductive plates extend in a triangular shape so that the triangular portion of one conductive plate is perpendicular to the opposite conductive plate, thereby forming a quadrangular pyramid by the first and second conductive plates.

* * * * *